United States Patent [19]

Lewis et al.

[11] 4,400,442

[45] Aug. 23, 1983

[54] FIBER REINFORCED ELECTROFORMED SUPERPLASTIC NICKEL-COBALT MATRICES

[75] Inventors: Jack R. Lewis, Granada Hills; Robert J. Walter, Thousand Oaks, both of Calif.

[73] Assignee: Rockwell International Corporation, El Sequndo, Calif.

[21] Appl. No.: 282,563

[22] Filed: Jul. 13, 1981

[51] Int. Cl.[3] ..... B32B 15/04

[52] U.S. Cl. ..... 428/544; 428/621; 428/634; 428/636; 428/678; 428/680; 428/935; 204/16

[58] Field of Search ..... 428/608, 621, 611, 614, 428/634, 544, 678, 635, 637, 680, 926, 935; 148/11.5 R, 11.5 N, 31.5; 204/16

[56] References Cited

U.S. PATENT DOCUMENTS 3,890,690 6/1975 Li ..... 428/614
4,191,617 3/1980 Hurley et al. ..... 428/678

FOREIGN PATENT DOCUMENTS 2147735 3/1973 Fed. Rep. of Germany ..... 428/608
5613780 11/1975 Japan ..... 428/614

OTHER PUBLICATIONS

Kreider, K. G.; *Metallic Matrix Composites,* vol. 4, pp. 24–29, 39–41, 208, 209, 258, 292, 293, 322–329, 335–337, 372–377, (1974).

Sims, C. T.; *The Superalloys,* John Wiley & Sons, New York, N. Y., pp. 430, 443, 572, 598–599, (1972).

Brenner, A.; *Electrodeposition of Alloys,* vol. II, Academic Press, pp. 188, 254, 264, (1963).

*Primary Examiner*—Michael L. Lewis

*Attorney, Agent, or Firm*—H. Fredrick Hamann; Harry B. Field

[57] ABSTRACT

There are provided fiber reinforced structures formed of one or more layers of reinforcing fibers contained in an electroformed, superplastic, nickel-cobalt matrix.

28 Claims, No Drawings

FIBER REINFORCED ELECTROFORMED SUPERPLASTIC NICKEL-COBALT MATRICES

BACKGROUND OF THE INVENTION

Boron and graphite are lightweight fibers of extraordinarily high strength. In order to use such fibers in a metal fiber reinforced matrix, it has been proposed to employ aluminum or titanium as the matrix. An aluminum matrix, however, has a limited operative temperature range because of low elevated temperature strength of aluminum. Titanium matrices are also temperature-limited because of inter-diffusion and intermetallic compound formation between titanium and carbon and/or boron. The need exists for high-strength, comparatively lightweight structures which employ boron, graphite and/or other fibers to increase strength, but which do not present the limitations of the matrix metals heretofore employed.

SUMMARY OF THE INVENTION

There is provided in accordance with the invention fiber reinforced structures comprising at least one layer formed of a plurality of reinforcing fibers contained in a matrix of an electroformed, superplastic, nickel-cobalt alloy. The electroformed, superplastic, nickel-cobalt alloy is comprised of from about 35% to about 65% by weight cobalt, preferably from about 40% to about 60% by weight cobalt, more preferably from about 40% to about 50% by weight cobalt.

The fibers of the reinforcing layer may be conductive or non-conductive and are preferably boron and/or carbon. They may be in the form of multifilament yarns and, if so, are preferably electrolessly plated prior to inclusion in the matrix. Total reinforcing fiber content of the matrix will normally range from about 30% to about 70% by volume.

A fiber reinforced structural composite laminate may be formed of at least one layer of a plurality of reinforcing fibers about which are placed electroformed, superplastic, nickel-cobalt alloy layers. Through application of heat and pressure, the layers conform to and bond to the fibers and, in the areas between the fibers, diffusion bond together. Superplastic behavior insures alloy flow to fill what zones would, in conventional laminates, be void spaces. The temperature limitation is the temperature at which the superplastic alloy will recrystallize. It is preferred to employ a temperature below about 1200° F., preferably from about 800° F. to about 1200° F., and more preferably from about 800° F. to about 1000° F. Pressures applied to achieve conforming diffusion bonding flow of the alloy layers will generally be above about 10,000 psi. When the laminate is formed by conformal compression, it is preferred to employ electroformed, superplastic, nickel-cobalt alloy layers of a thickness of from about 5 to about 10 mils, and reinforcing filaments or fibers or a thickness up to about 10 mils. The laminate can be fabricated to any thickness using alternate layers of superplastic, nickel-cobalt alloy reinforcing fibers.

The structures can also be formed by positioning non-conductive reinforcing fibers adjacent to a cathode within an electrodeposition cell and causing the electroformed, superplastic, nickel-cobalt alloy to grow outward from the cathode to a thickness sufficient to envelope the reinforcing fibers.

An alternate route applicable to conductive reinforcing fibers is to utilize them as the cathode and plate and the matrix onto the conductive reinforcing fibers. This tends to leave void spaces, particularly in multilayered structures. The voids can, however, be readily eliminated by application of heat and pressure sufficient to cause flow of the superplastic, nickel-cobalt alloy.

DETAILED DESCRIPTION

According to the present invention, there are provided fiber reinforced structures formed of reinforcing filaments, preferably of boron and graphite, contained in a matrix of electroformed, superplastic, nickel-cobalt alloys which contain from about 35% to about 65% by weight cobalt, and preferably from about 40% to about 60% by weight cobalt, and most preferably from about 40% to about 50% by weight cobalt. The electroformed matrix exhibits superplastic behavior due to extremely fine grain size.

One method of achieving the final structure is to sandwich the reinforcing fibers between self-supporting layers of the electroformed, superplastic, nickel-cobalt alloys, and by the use of heat and pressure, causing the superplastic, nickel-cobalt alloy to bond to the fibers and fill the void spaces between reinforcing fibers and diffusion bond together.

Another method particularly useful where the fibers are in yarn form, that is, composed of a plurality of filaments, is to electrolessly plate the filaments with a metal, particularly nickel or nickel and cobalt, to at least uniformly coat all the fibers of the yarn. The electrolessly plated yarn may then be sandwiched between layers of the electroformed, superplastic, nickel-cobalt forming the matrix; or used as a cathode surface upon which the superplastic, nickel-cobalt alloy will plate. Any voids formed in the electroforming or electrodeposition process can be eliminated by application of heat and pressure.

An alternate method applicable to non-conductive fibers is to position the fibers at the surface of a cathode in spaced relation thereto, and electrodeposit the superplastic, nickel-cobalt alloy about the fiber to coat the surface of the fibers; fill all interstices between the fibers and, in the end product, envelope the reinforcing fibers.

More particularly, the novel fiber reinforced structures of the present invention are those in which the matrix is an electroformed or electrodeposited superplastic, nickel-cobalt alloy. By "an electroformed, superplastic, nickel-cobalt alloy," there is meant alloys comprising nickel and cobalt which are of very fine grain size, typically in the order of a few microns. Magnification of about 20,000× is required to ascertain grain size. The alloys display the property of uniform stretching, with no indication of necking, using a tensile strain rate of from about 0.02 to about 0.05 in/in/min. Elongation is in excess of 100%, with up to 120% or more being achieved.

The superplastic, nickel-cobalt alloys comprise from about 35% to about 65% by weight cobalt, preferably from about 40% to about 60% by weight cobalt, more preferably from about 40% to about 50% by weight cobalt, and are electroformed from aqueous nickel-sulfamate-cobalt electrolytes. Other metals such as iron may be present in minor amounts, provided the fine-grain, superplastic structure is not affected. To provide electrodeposits of desired alloy composition, electrolytes of high nickel content are employed and can contain from about 35 to about 10 parts by weight of ionic nickel to each part by weight ionic cobalt. The amount of cobalt appearing in the electrodeposited alloy will increase with a decrease in nickel content of the electrolyte. It is preferred to employ an electrolyte in which the weight ratio of nickel to cobalt is about 20 to 1. The aqueous electrolyte has a pH of from about 3.8 to about 4.2, and is comprised of conventional wetting agents, buffering agents such as boric acid, and sulfamic acid. Total metal ion content is from about 70 to about 80 grams/liter. Deposition of a plate onto a cathode is normally achieved at electrolyte temperatures of about 120° F. Current density can range from about 20 to about 60 amps/ft.$^2$, preferably about 40 amps/ft.$^2$.

In the process electrolyte agitation must be sufficient to insure cobalt concentration polarization at the cathode is insignificant. To this end, electrolyte flow requirement increases with increasing current density.

The fiber reinforced matrices of the instant invention are formed from conductive and/or non-conductive fibers. Representatives of non-conductive fibers include glass fibers and organic fibers such as Aramid TM fibers. Aramid is a tradename applied to certain polyamide fibers manufactured and sold by DuPont. Conductive fibers include carbon, boron and the like. Carbon and boron fibers are preferably employed. Useful reinforcing fibers are disclosed in U.S. Pat. Nos. 3,356,525; 3,375,308; 3,488,151; 3,531,249 and 3,770,488, incorporated herein by reference.

The fibers employed may be uni-directional or multi-directional and can be single filaments or yarns formed of multi-filaments. They may be in planar configurations or non-planar configurations, such as configurations formed on mandrels. Multi-layered configurations are the most commonly formed net constructions.

One basic method of forming the fiber reinforced matrix is to apply to opposite sides of a reinforcing fiber substrate self-supporting layers of electroformed, superplastic, nickel-cobalt alloy and, by the application of heat and pressure, causing metal to flow and fill the void spaces between the fibers and create bonds to the fiber surfaces and diffusion bonding of the alloy surfaces. The temperature of flow is below the recrystallization temperature, namely, the temperature at which the alloy will recrystallize and exhibit a growth in grain size. The upper limit of temperature is about 1200° F., the temperature at which flow can be achieved without recrystallization increasing with increasing cobalt content. It is preferred that the temperature of flow be from about 800° F. to about 1200° F., preferably from about 800° F. to about 1000° F. The pressure applied is normally dependent upon layer thickness, but must be sufficient to achieve alloy flow. Normally, the pressure applied is above about 10,000 psi.

The reinforcing fibers employed normally have a net thickness of about 7 to about 10 mils, but may be thicker or thinner. The electroformed layers of the electroformed, superplastic, nickel-cobalt alloy will have thicknesses ranging from about 5 mils or more to about 10 mils or less. Fiber content of the matrices will normally range from about 30% to about 70% by volume, preferably about 50%. The use of alternate layers of fibers and electroformed, superplastic, nickel-cobalt alloy will enable a laminate to be constructed to any desired thickness.

With the application of sufficient heat and pressure, diffusion bonding within the operative superplastic temperature of the nickel-cobalt alloy will occur. In the fabrication scheme, the superplastic behavior of the electroformed, nickel-cobalt alloy insures high grain-boundary movement, which is utilized to envelope the fibers on application of heat and pressure, and bond to faying of stacked multiple layers. By use of heat and pressure, any desired configuration can be achieved, the limitation being only that of the molds of the like employed to define the shape of the net end product.

Another method, preferably applied to non-conductive fibers, is to position the fibers about which the matrix is to be formed adjacent to the cathode in the electrodeposition cell. The electrodeposited, superplastic, nickel-cobalt alloy will grow from the cathode surface and envelope the reinforcing fibers, coating all fibers of the array, including the void spaces between them.

Yet another method applicable to non-conductive fibers is then positioning of the reinforcing fibers about which the matrix is to be formed adjacent, and in spaced relation to, a cathode conforming to the configuration of the matrix to be formed in an electrodeposition cell. As the electrodeposited, superplastic, nickel-cobalt alloy accumulates at and grows at the cathode, it will envelope the non-conductive fibers, uniformly coating the fibers and filling the void spaces between them.

Electrodeposition onto conductive fibers employed as a cathode may also be employed, but electrical interference between layers of fibers will cause the formation of cusps or triangular void spaces. The void spaces can be readily eliminated, however, by application of heat and pressure.

Where yarns are employed, it is desirable to uniformly coat the filaments of the yarns by electroless plating. Electroless plating is a technique well-known in the art whereby a catalytic surface or a catalytic surface formed by seeding with a noble metal catalyst is immersed in an electroless plating solution which causes spontaneous decomposition of the solution and metal plating on the surface. Nickel and nickel-cobalt can be readily deposited electrolessly. In this process, each individual filament of the yarn will become coated with the plate. Plating may be allowed to continue until the coatings merge and substantially fill all voids between the fibers. In the alternative, the application of heat and pressure will cause diffusion bonding of the electrolessly deposited coating as part of forming the fiber reinforced matrix.

Whatever mode of fiber reinforced matrix construction is followed, the employment of electrodeposited, superplastic, nickel-cobalt alloys of this invention enable the formation of intricate parts of any desired shape. For instance, intricate and complex parts of preformed reinforcing fibers can be electrodeposited with the superplastic, nickel-cobalt alloy to any desired thickness. If strengthening or elimination of void spaces is required, heat and pressure sufficient to cause alloy flow can be applied within the superplastic temperature limits of the alloy.

The matrices of the instant invention have the utility of any fiber reinforced structure in providing extraordinarily high strength per unit weight. Applications range from the formation of rocket nozzles to memory cores.

It is to be understood that what has been described is merely illustrative of the principles of the invention and that numerous arrangements in accordance with this invention may be devised by one skilled in the art without departing from the spirit and scope thereof.

What is claimed is:

1. A fiber reinforced structure comprising at least one layer comprised of a plurality of reinforcing fibers contained in a matrix consisting essentially of an electroformed, superplastic, nickel-cobalt alloy.

2. A fiber reinforced structure as claimed in claim 1 in which the electroformed, superplastic, nickel-cobalt alloy is comprised of from about 35% to about 65% by weight cobalt.

3. A fiber reinforced structure as claimed in claim 1 in which the electroformed, superplastic, nickel-cobalt alloy is comprised of from about 40% to about 60% by weight cobalt.

4. A fiber reinforced structure as claimed in claim 1 in which the electroformed, superplastic, nickel-cobalt alloy is comprised of from about 40% to about 50% by weight cobalt.

5. A fiber reinforced structure as claimed in claim 1 in which the reinforcing fibers are selected from the group consisting of carbon fibers and boron fibers.

6. A fiber reinforced structure as claimed in claim 1 in which the reinforcing fibers comprise from about 30% to about 70% by volume of the fiber reinforced structure.

7. A fiber reinforced structure as claimed in claim 1 in which the reinforcing fibers are composed of filaments forming a yarn and in which the filaments of the yarn are electrolessly plated.

8. A fiber reinforced structure comprising a laminate of:

(a) at least one layer comprised of a plurality of reinforcing fibers;

(b) a first self-supporting layer consisting essentially of an electroformed, superplastic, nickel-cobalt alloy providing a first surface partially bonded to said reinforcing fibers and partially disposed between said reinforcing fibers; and (c) a second self-supporting layer consisting of an electroformed, superplastic, nickel-cobalt alloy providing a second surface partially bonded to said reinforcing fibers and diffusion bonded to said first surface.

9. A fiber reinforced structure as claimed in claim 8 in which each electroformed, superplastic, nickel-cobalt alloy contains from about 35% to about 65% by weight cobalt.

10. A fiber reinforced structure as claimed in claim 8 in which each electroformed, superplastic, nickel-cobalt alloy contains from about 40% to about 60% by weight cobalt.

11. A fiber reinforced structure as claimed in claim 8 in which each electroformed, superplastic, nickel-cobalt alloy contains from about 40% to about 50% by weight cobalt.

12. A fiber reinforced structure as claimed in claim 8 in which the reinforcing fibers are selected from the group consisting of carbon fibers and boron fibers.

13. A fiber reinforced structure as claimed in claim 8 in which the reinforcing fibers are composed of filaments forming a yarn and in which the filaments of the yarn are electrolessly plated.

14. A fiber reinforced structure as claimed in claim 8 in which the reinforcing fibers comprise from about 30% to about 70% by volume of the fiber reinforced structure.

15. A fiber reinforced structure as claimed in claim 8 in which each electroformed, superplastic, nickel-cobalt alloy layer is independently of a thickness of from about 7 to 10 mils.

16. A fiber reinforced structure as claimed in claim 8 in which the reinforcing fibers have a thickness of from about 5 to about 10 mils.

17. A fiber reinforced structure comprised of a laminate of:

(a) at lease one layer of reinforcing fibers formed of fibers selected from the group consisting of carbon fibers and boron fibers;

(b) a first self-supporting layer consisting essentially of an electroformed, superplastic, nickel-cobalt alloy containing from about 35% to about 65% by weight cobalt, said first layer providing a first surface partially bonded to said reinforcing fibers and partially disposed between said reinforcing fibers;

(c) a second self-supporting layer consisting essentially of an electroformed, superplastic, nickel-cobalt alloy containing from about 35% to about 65% by weight cobalt, said second layer providing a second surface partially bonded to said reinforcing fibers and diffusion bonded to said first surface.

18. A fiber reinforced structure as claimed in claim 17 in which each electroformed, superplastic, nickel-cobalt alloy contains from about 40% to about 60% by weight cobalt.

19. A fiber reinforced structure as claimed in claim 17 in which each electroformed, superplastic, nickel-cobalt alloy contains from about 40% to about 50% by weight cobalt.

20. A fiber reinforced structure as claimed in claim 17 in which the reinforcing fibers comprise from about 30% to about 70% by volume of the fiber reinforced structure.

21. A fiber reinforced structure as claimed in claim 17 in which each electroformed, superplastic, nickel-cobalt alloy layer is independently of a thickness of from about 7 to about 10 mils.

22. A fiber reinforced structure as claimed in claim 17 in which the reinforcing fibers have a thickness of from about 5 to about 10 mils.

23. A fiber reinforced structure as claimed in claim 17 in which the reinforcing fibers are composed of filaments forming a yarn and in which the filaments of the yarn are electrolessly plated.

24. A fiber reinforced structure comprising at least one layer comprised of non-conductive reinforcing fiber filaments contained within a layer consisting essentially of an electroformed, superplastic, nickel-cobalt alloy matrix formed by electrodeposition of said matrix outward from a cathode to envelope said layer of reinforcing fibers.

25. A fiber reinforced structure as claimed in claim 24 in which the electroformed, superplastic, nickel-cobalt alloy contains from about 35% to about 65% by weight cobalt.

26. A fiber reinforced structure as claimed in claim 24 in which the electroformed, superplastic, nickel-cobalt alloy contains from about 40% to about 60% by weight cobalt.

27. A fiber reinforced structure as claimed in claim 24 in which the electroformed, superplastic, nickel-cobalt alloy contains from about 40% to about 50% by weight cobalt.

28. A fiber reinforced structure as claimed in claim 24 in which the non-conductive reinforcing fibers comprise from about 30% to about 70% by volume of the fiber reinforced structure.

* * * * *

UNITED STATES PATENT AND TRADEMARK OFFICE

CERTIFICATE OF CORRECTION

PATENT NO. : 4,400,442

DATED : Aug. 23, 1983

INVENTOR(S) : J. R. Lewis et al.

It is certified that error appears in the above-identified patent and that said Letters Patent are hereby corrected as shown below:

Column 5, line 67, after "to" insert --about-- .

Signed and Sealed this

*Twenty-ninth* Day of *May 1984*

[SEAL]

*Attest:*

GERALD J. MOSSINGHOFF

*Attesting Officer*

*Commissioner of Patents and Trademarks*